United States Patent [19]

Seitz et al.

[11] Patent Number: 4,566,618

[45] Date of Patent: Jan. 28, 1986

[54] PAPER FEED TRACTOR WITH COMPENSATING PULLEY ASSEMBLY UTILIZING CANTABLE INSERT

[75] Inventors: Alan F. Seitz, New Hartford; Karl G. Seitz, Goshen, both of Conn.

[73] Assignee: Data Motion, Inc., Torrington, Conn.

[21] Appl. No.: 550,362

[22] Filed: Nov. 10, 1983

[51] Int. Cl.[4] ..... B65H 17/40

[52] U.S. Cl. ..... 226/74; 226/171; 400/616.1

[58] Field of Search ..... 226/74, 75, 190, 170, 226/171, 172; 400/616, 616.1, 616.2, 616.3; 474/94, 902, 903; 464/104, 150, 151, 158, 159, 106

[56] References Cited

U.S. PATENT DOCUMENTS

| | | | |
|---|---|---|---|
| 288,134 | 11/1883 | Stone, Jr. | 464/75 X |
| 427,810 | 5/1890 | Thomas | 474/94 |
| 1,585,119 | 11/1923 | Schroeder | 464/150 |
| 2,919,916 | 9/1956 | Davidson et al. | 226/81 |
| 3,015,425 | 6/1959 | Wicklund | 226/74 |
| 3,321,935 | 1/1965 | Wildhaber | 464/75 |
| 3,688,959 | 9/1972 | Staneck et al. | 226/75 |
| 3,693,856 | 9/1972 | Funk | 226/74 |
| 3,750,919 | 8/1973 | Hoffman | 226/9 |
| 3,930,601 | 1/1976 | Masuda | 226/74 |
| 3,940,946 | 3/1976 | Andersen | 464/89 |
| 3,941,288 | 3/1976 | Wanat | 226/74 |
| 4,129,239 | 12/1978 | Hubbard | 226/75 |
| 4,239,405 | 12/1980 | Van Horne et al. | 400/616.1 |
| 4,315,585 | 2/1982 | Seitz | 226/74 |

*Primary Examiner*—Harvey C. Hornsby
*Assistant Examiner*—Scott J. Haugland

[57] ABSTRACT

A tractor for a web feeding assembly having spaced support and drive shafts has a chassis providing a pair of apertures extending therethrough and a belt extending thereabout. A drive pulley mounted in one of the chassis apertures is engaged with the driven surface of the belt and has an aperture therethrough receiving the drive shaft, and a cantable insert within a pulley body defines at least a portion of the drive shaft receiving aperture. As a result, irregularities in the drive shaft, and variations in axial spacing of the shafts occurring during operation, may be accommodated by canting movement of the cantable insert within the pulley body. A convexly arcuate belt support surface cooperates with the drive pulley to define the web drive path for the belt therebetween. A resilient spring clamp is mounted adjacent the other aperture in the chassis and releasably clamps the tractor on the support shaft. The mounting desirably permits the clamp to rotate about the axis of the aperture receiving the support shaft.

22 Claims, 10 Drawing Figures

PAPER FEED TRACTOR WITH COMPENSATING PULLEY ASSEMBLY UTILIZING CANTABLE INSERT

BACKGROUND OF THE INVENTION

The present invention relates to drive tractors which are widely used in printers and other devices for handling webs such as continuous perforated paper, individual sheet paper, tape and the like, of paper, foil, laminates and other sheet-like material, all collectively referred to hereinafter as "web material".

Generally such devices employ a belt which will engage the web material either by pins or projections on the upper surface of the belt extending into perforations in the web material or by friction or "clamping" of the web material between the upper surface of the belt and a cover or guide thereabove. Such devices are in widespread use for the applications indicated above are particularly burgeoning in usage for paper handling in printers for computers, word processing and duplicating apparatus.

Among the problems which have been encountered in the use of such tractors are aberrations in cross section in the drive shaft upon which the tractors are mounted, bowing or other deflection of the shafts causing variation in the distance between the end of the pair of tractors mounted thereon and cooperating to drive the web material, and deflection of the shafts during operation causing variation in the tension on the web material being driven. Tolerances in the shaft receiving apertures of the tractors, or in the clamping means, or both, have been proposed to accommodate the shaft irregularities discussed above. Hubbard U.S. Pat. No. 4,129,239 granted Dec. 12, 1978 discloses a tractor in which the clamping mechanism for the support shaft is a part of a pillow block on the chassis which may "float" in spacing relative to the drive shaft.

Particularly in high speed web handling devices, it is important that the spacing between the paper guiding surfaces of the pair of cooperating tractors and in fact between the shaft receiving portions be maintained substantially constant and that the tractors do not move in the direction of web travel. This spacing and fixed positioning is critical to uniform advance of the web material, particularly when the drive tractor is bidirectional, i.e., movable backward and forward abruptly. Thus, there is need to accommodate aberrations in the shafts and variations in spacing between their axes while maintaining constant the distance between axes of the paper guide surfaces and the axes of the shaft receiving apertures and while avoiding any movement of the tractor relative to the printer or other device on which it is mounted. If not, undesirable variations in line spacing during printing of the web may occur.

It is an object of the present invention to provide a novel drive tractor for web material which readily accommodates aberrations in the drive shaft cross section and deviations in spacing between the axes of the drive and support shafts while maintaining essentially constant the axial spacing of the web guide surfaces and of the shaft receiving apertures in the tractor chassis.

It is also an object to provide such a novel drive tractor which may be fabricated readily and relatively economically and which will enjoy long life in operation.

Another object is to provide such a tractor which remains fixed on the printer or drive device upon which it is mounted so as to avoid variations in tension on the web material being driven thereby and line spacing of the printing on the web.

A further specific object is to provide such a tractor wherein the drive shaft may deflect within the drive pulley without effecting variation in spacing of the drive pulley relative to the other web guide surface or the support shaft receiving aperture.

SUMMARY OF THE INVENTION

It has now been found that the foregoing and related objects can be readily attained in a drive tractor which includes a chassis having a pair of spaced transversely extending apertures therein with at least one aperture being adjacent an end thereof. Extending about the chassis generally perpendicularly to the axes of the apertures is a flexible endless belt which defines a closed path of travel thereabout. The belt has an outer driving surface to engage the web material and an inner driven surface which is engaged with a drive pulley rotatably mounted in the chassis aperture adjacent the end thereof. The drive pulley has an aperture therethrough for receiving a drive shaft to effect its rotation and thereby the belt, and this pulley also has a cantable insert mounted therewithin for relative movement within a passage in the pulley body and defining a portion of the drive shaft receiving aperture passage therein. As a result, the drive shaft may produce orientation of the cantable insert within the drive pulley body to effect accommodation of irregularities in the shaft and spacing between it and the support shaft.

Preferably, the cantable insert and pulley body are cooperatively configured by providing a polygonal cross section for at least a portion of the cantable insert and of the body passage to effect driving engagement between the insert and the pulley body. The cantable insert and pulley body passage are cooperatively dimensioned to provide spacing therebetween. A wall of a body portion of the cantable insert tapers or decreases in cross sectional area from one end of the body portion to the other end thereof to increase the spacing between the parts and provide a reduced cross section for driving engagement by the associated drive shaft.

The pulley includes a pulley cap engaged on one end of the pulley body to retain the cantable insert within the passage of the pulley body for canting therein.

The assembly will normally include means for clamping the chassis on a support shaft mounted on the chassis and having its axis extending parallel to the axis of the aperture of the first mentioned pulley. Generally, the second aperture receives the support shaft, and the clamping means is mounted on the chassis adjacent thereto. The clamp means will preferably maintain the original spacing between the support and drive shafts and relieves torque initiated as the clamping means engages the associated support shaft.

The tractor may include a convexly arcuate belt support surface formed on the chassis at its end spaced from the drive pulley, or an idler pulley provided thereon, to support and guide the belt. The center for the radius of this arcuate surface, or idler pulley, is fixed so that the spacing between the axis of the drive pulley and the center for the arcuate guide surface or pulley is fixed and predetermined.

Thus in the tractors of this invention, the spacing between the axes of the drive pulley and of the cooperating arcuate guide surface is fixed and predetermined and the axial spacing between the drive pulley aperture and the support shaft aperture is fixed and predetermined. However, irregularities in the drive shaft, variations in spacing between the shafts and deflection of the drive shaft is accommodated by orientation of the cantable insert within the pulley.

Our invention will be fully understood when reference is made to the following detailed description taken in conjunction with the accompanying drawings.

DETAILED DESCRIPTION OF THE ILLUSTRATED EMBODIMENT

Figure 1:
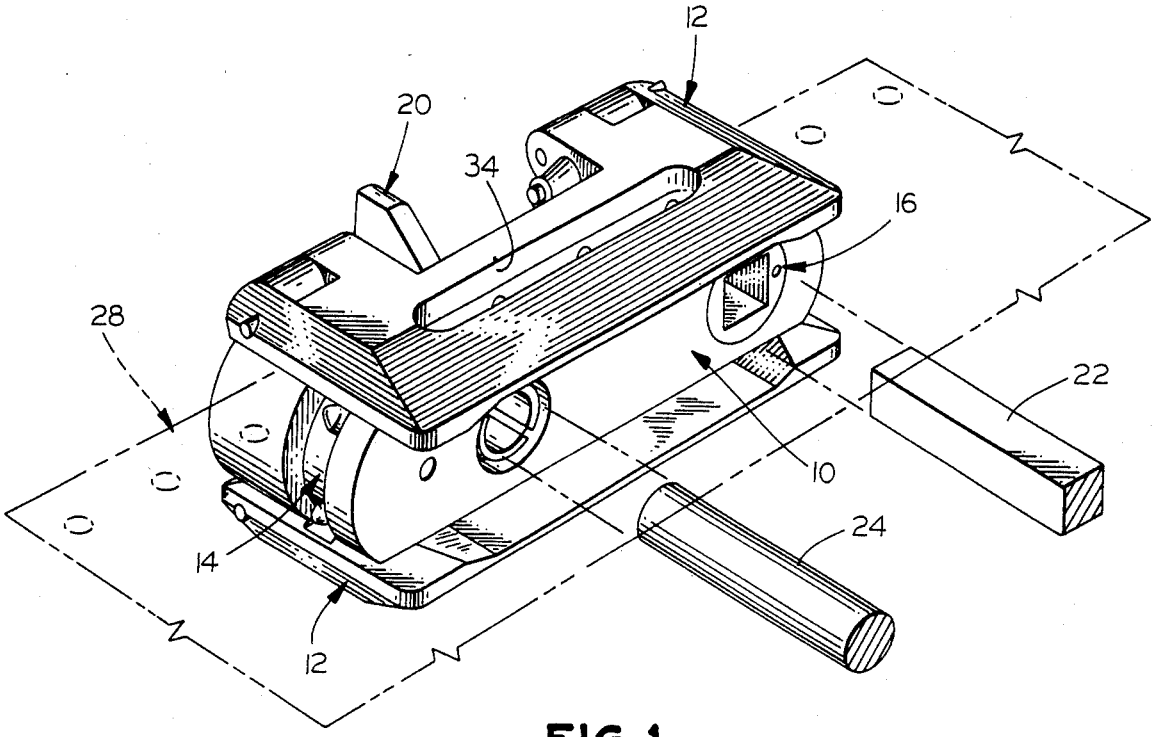
FIG. 1 is a perspective view of a tractor embodying the present invention, also showing the drive and support shafts fragmentarily illustrated in solid line and in spaced relationship to the chassis apertures in which they are received, and also showing the paper web fragmentarily in phantom line.
Figure 2:
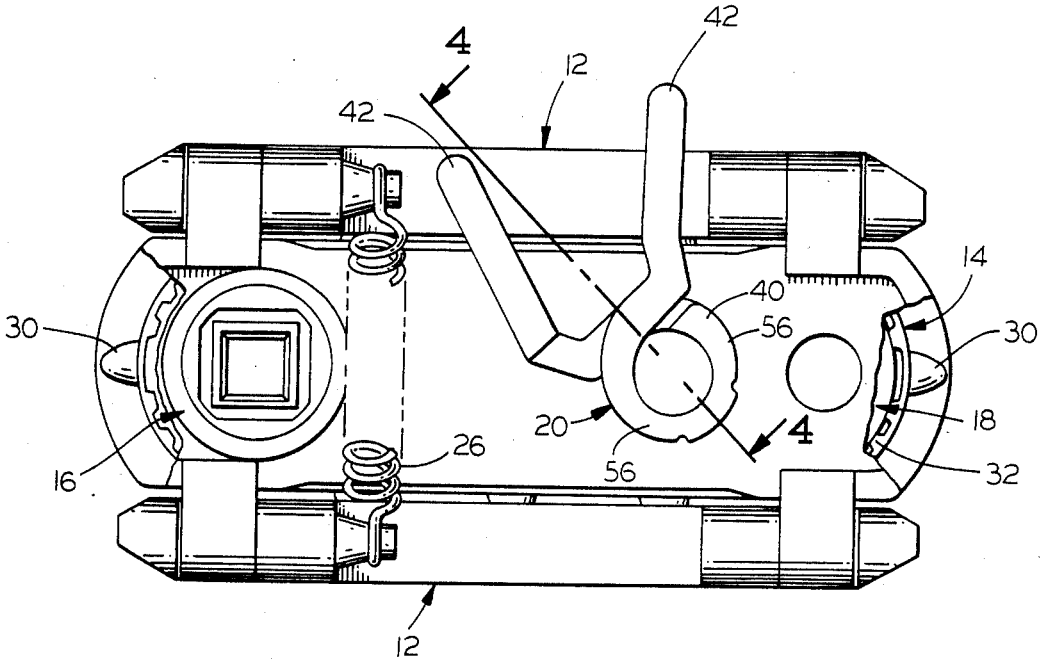
FIG. 2 is an elevational view of the opposite side thereof with portions of the chassis broken away for clarity of illustration.

Turning first to FIGS. 1 and 2 of the drawings, therein illustrated a tractor embodying the present invention and comprised of a chassis generally designated by the numeral 10, a pair of covers each generally designated by the numeral 12, a drive belt generally designated by the numeral 14, a compensating drive pulley or sprocket generally designated by the numeral 16, an arcuate or convexly curved guide surface generally designated by the numeral 18, and a spring clamp subassembly generally designated by the numeral 20.

Also shown in FIG. 1 are fragmentary portions of the drive shaft 22 of rectangular cross section and the support shaft 24 of circular cross section upon which a pair of the tractors are mounted (only one shown). The tractors are axially movable on the shafts 22 and 24 to adjust the spacing between the tractors for use with webs of material having different widths. A web of perforated paper generally designated by the numeral 28 is shown disposed between the upper cover 12 and belt 14 to be driven along a path defined by the upper surface of the belt 14 when the drive shaft 22 is rotated by the printer or other powered device (not shown) as is conventional.

The endless belt 14 is a one-piece continuous belt integrally molded from synthetic resin and extending about drive sprocket 16 and the arcuate guide surface 18. Thus, the belt 14 follows an endless closed path around the chassis 10 of the tractor as it is driven by the drive sprocket 16. Belt 14 has plurality of projections or pins 30 equally spaced along the outer drive surface thereof for engaging the perforations in the web material 28 to be driven thereby. As depicted in FIG. 2, the inner driven surface of the belt 14 has a plurality of tooth elements 32 formed thereon which engage the teeth of the drive sprocket 16 to allow the belt 14 to be driven thereby. The tooth elements 32 slide on arcuate surface 18 of the tractor chassis 10 as the belt 14 moves in its path thereabout.

This type of one-piece molded belt 14 has a natural resiliency or memory resulting from its being molded as a circle which produces an inherent tendency to arch outwardly from chassis 10 as the belt 14 traverses its path between drive sprocket 16 and arcuate surface 18. As a result of this tendency, web material 28 will be positively engaged by belt projections 30 as the belt 14 biases the web material 28 upwardly against the cooperating cover 12. Each of covers 12 is provided with an elongated slot 34 to allow the projections 30 of the belt 14 to extend upwardly therein.

Covers 12 are pivotally received on chassis 10 and are provided with an over-center biasing arrangement utilizing spring 26 which extends between the pair of covers 12 and biases them in both the open and closed positions, as is well known in the art. The pair of covers 12 is positioned over the top and bottom portions of the closed belt path extending between drive pulley 16 and arcuate surface 18 to allow the tractor to function as a bidirectional tractor.

The general features of construction of the belt 14 and covers 12 are generally described in Seitz U.S. Pat. No. 4,315,585.

Figure 3:
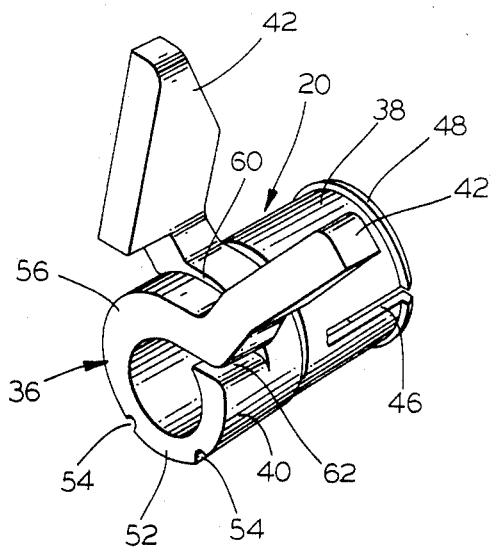
FIG. 3 is a perspective view of the resilient spring clamp.

The tractor of the present invention is clamped by means of the resilient spring clamp subassembly 20 on the support shaft 24 and is movable in the axial direction thereon by releasing the spring clamping subassembly 20. The spring clamp subassembly 20 is a one-piece integrally molded structure made from a resiliently deflectable synthetic resin material exhibiting relatively little creep. As is best seen in FIGS. 2 and 3, the clamp subassembly 20 includes the cylindrical mounting or support element 38 and the resilient spring clamp element generally designated by numeral 36 generally comprised of the cylindrical barrel portion 40 and a pair of laterally outwardly extending manually engageable tab portions 42. The support element 38 comprises a cylindrical support sleeve or post having an aperture therethrough with an inner diameter greater than the diameter of the support shaft 24 to be received therein. The support element 38 has a pair of diametrically opposed, axially extending slots 46 therein and a circumferential collar 48 extending outwardly at the outer end thereof.

Figure 4:
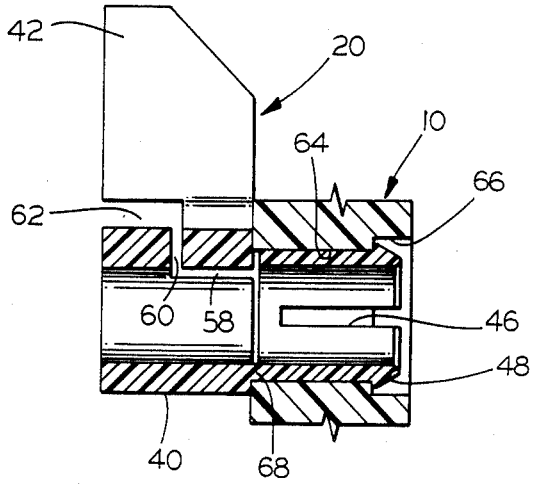
FIG. 4 is a fragmentary sectional view of the clamp along the line 4—4 of FIG. 2.

Referring further to FIGS. 2–4, the barrel portion 40 of the spring clamp element 36 provides a passage in which the support shaft 24 is resiliently clamped.

The barrel portion 40 has two axially extending slots or slits 58, 62 and a circumferentially extending slot or slit 60, all of which extend through its wall. The first slot 58 extends axially along the barrel portion 40 from its inner end adjacent the chassis 10 to a midsection of the barrel portion 40 spaced outwardly from the chassis 10. As shown in FIGS. 3 and 4, the second slot 60 extends from an outer end of the first slot 58 circumferentially around the barrel portion 40 at the midsection thereof for a segmental length of about 90 to 180 degrees. The third slot 62 extends axially outwardly from the circumferential slot 60 at a point spaced circumferentially around the barrel portion 40 from the first slot 58 to the outer end of the barrel portion 40. To provide the resilient clamping action, the barrel portion 40 has an arcuately shaped wall portion 52 of substantially uniform thickness opposite the circumferential slot 60 and a pair of axially extending grooves 54 providing a reduced thickness on either side thereof and functioning to form resilient hinge portions. Extending circumferentially from each of grooves 54 to the tab portions 42 are arcuate spring portions 56 which increase in thickness towards the tab portions 42. The spring wall portions 56 of the barrel 40 are cooperatively dimensioned to define the first, second and third slots. Mounted adjacent the first and third slots 58, 62 are the pair of manually engageable tab portions 42 which extend laterally outwardly from the barrel portion 40.

Figure 5:
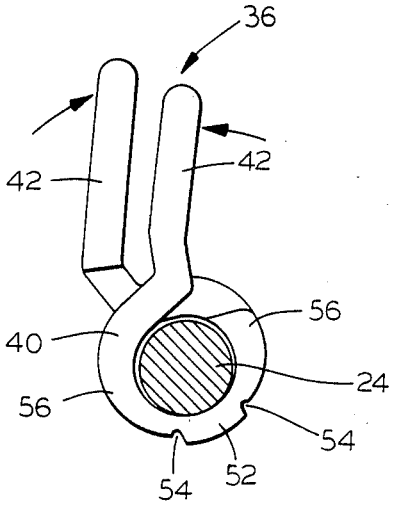
FIGS. 5 and 6 are side elevational views of the spring clamp in the unclamped and clamped positions, respectively, about a sectional support shaft extending therethrough.
Figure 6:
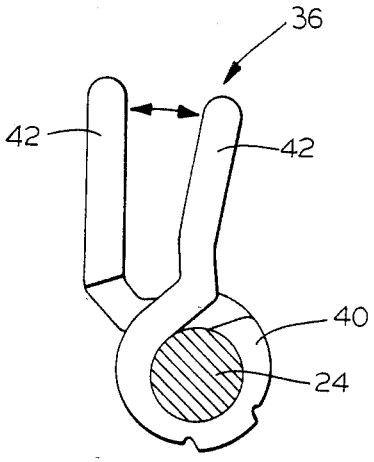

FIGS. 5 and 6 illustrate the spring clamp 36 in the releasing and clamping positions relative to the support shaft 24. The relative positioning of the various wall portions and slots in the spring clamp element 36 allows the arcuate wall portions 56 to flex around the resilient hinge portions when tab portions 42 are manually moved towards one another. Uniform thickness wall portion 52 reinforces the spring clamp 36 and increases the spring pressure thereof.

In FIG. 5, the tab portions 42 are being manually moved towards one another against the natural resiliency of barrel portion 40 of spring clamp element 36 to increase the effective diameter of the passage therethrough and release the support shaft 24 to allow axial movement of the tractor relative to the support and drive shafts. When the finger pressure on the tab portions 42 is released, the natural resiliency and memory of the molded plastic spring clamp 36 will return barrel portion 40 into its closed or clamped position to securely or firmly clamp the support shaft 24 within the barrel passage, as shown in FIG. 6.

It should be noted that the passage within the barrel portion 40 as shown in FIG. 2 is slightly out of round when the spring clamp 36 is in its completely closed or at rest position with no shaft received therein since the arcuate spring portions 56 are biased inwardly of a true circle. However, when a support shaft 24 is disposed within the passage as pictured in FIG. 6, it moves the spring portions 56 outwardly and the natural resiliency of the spring clamp 36 will cause the barrel portion 40 to completely surround and resiliently clamp the support shaft 24 therein. The natural resiliency of the spring clamp element 36 is such that variations in the outer diameter of the support shaft 24 may be accommodated.

The clamp element 36 is rotatably mounted within the chassis 10. As seen, the support element 38 is rotatably received within support shaft aperture 64 of chassis 10 thereby allowing relative rotation between the spring clamp subassembly 20 and the remainder of the tractor. This relieves torque on the drive shaft 22 while minimizing variations in the center to center spacing between the shafts.

Turning to FIG. 4, therein illustrated in detail is the mounting of the spring clamp element 36 on the chassis 10 by use of the cylindrical support element 38 which has axially extending slots 46 therein which are diametrically spaced. At one end of the cylindrical support element 38 is the enlarged collar 48 which seats in a mating recess 66 in the chassis 10 on the side opposite the spring clamp element 36. The slots 46 allow the cylindrical support element 38 to deflect inwardly as the cylindrical support element 38 is inserted into the support shaft aperture 64 from the end opposite the mating recess 66. After the cylindrical support element 38 has been fully inserted into the support shaft aperture 64, the natural resiliency thereof will bias the collar 48 into the mating recess 66. As a result, the clamp subassembly 20 is held in assembly with the chassis 10 as shown in FIG. 4. However, the inner diameter of the support shaft aperture 66 and outer diameter of the cylindrical support element 38 are cooperatively dimensioned so that the support element 38 may rotate within the chassis 10.

In FIG. 4, the spring clamp subassembly 20 is shown to include a spacer portion 68 which extends between the end of cylindrical support element 38 and the inner end of the uniform thickness portion 52 of the barrel portion 40. The resultant spacing allows the resilient arcuate spring portions 56 to move freely relative to the support element 38 at a point adjacent the chassis 10 as tab portions 42 are pressed towards one another to enlarge the barrel passage.

The spring clamp subassembly operates in the following manner. After the tractor is mounted on the support and drive shafts, the operator may wish to reposition the tractors based upon the width of the web of perforated paper to be driven thereby. The operator simply presses tab portions 42 towards one another as depicted in FIG. 5 to enlarge the barrel passage and release the support shaft 24, moves the tractor axially along the support and drive shafts to the desired position and then releases the finger pressure on the tab portions 42 to allow the spring clamp 36 to resiliently clamp the support shaft 24 as shown in FIG. 6 and prevent further axial movement thereof. Paper web 28 is then positioned on belt pins 30 between chassis 10 and the appropriate cover 12.

The spring clamp subassembly is more fully described in the copending application of Arthur John James Milano, Jr., Ser No. 6,543,490 filed Oct. 19, 1983, entitled SHEET-FEED TRACTOR WITH RESILIENT SPRING CLAMPING SUBASSEMBLY, and also assigned to the present assignee.

Figure 7:
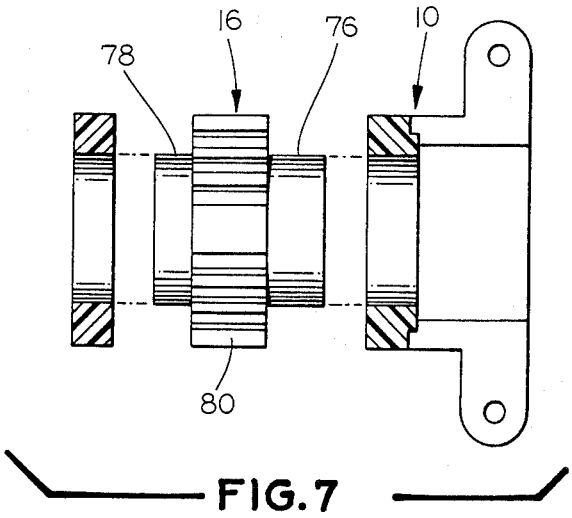
FIG. 7 is a partially exploded view of the drive pulley and chassis components with the chassis components in partial section.

Turning now in detail to FIGS. 7 through 10, illustrated therein is a drive pulley 16 embodying the present invention and having a three-piece molded plastic construction comprised of a compensating pulley body generally indicated by the numeral 70 with a cantable insert generally indicated by the numeral 72 mounted therein and a cap 74 engageable on the pulley body 70. FIG. 7 shows the rotatable mounting of the drive pulley 16 within the chassis 10 of the paper feed tractor, in which its pair of axially extending journal portions 76 and 78 projecting from either end thereof rotatably seat within the circular drive shaft aperture or journal bearing in the spaced side walls of the chassis 10.

The compensating pulley body 70 has a generally cylindrical wall 80 with sprocket teeth extending circumferentially thereabout, and through the center of the compensating pulley body 70 is a passage 81. In one end of the pulley body 70 about the passage 81 is a polygonal or hexagonal recess 82 which seats the cooperatively configured collar 94 of the cantable insert 72. Coaxially disposed about the hexagonal recess 82 and extending axially outwardly thereof is a circular recess 84 formed in the generally cylindrical wall 80 and seating the compensating pulley cap 74 to capture the cantable insert 72 within the passage 81 as will be described hereinafter. The pulley body 70 has three circumferentially spaced and axially extending apertures 86 opening at the recess 84 which seat the axially extending pins 88 on the compensating pulley cap 74. A key groove 90 molded in the pulley body 70 is located at one side of the hexagonal recess 82 and receives a key boss 96 on the insert 72 to locate it relative to the body 70.

Figure 8:
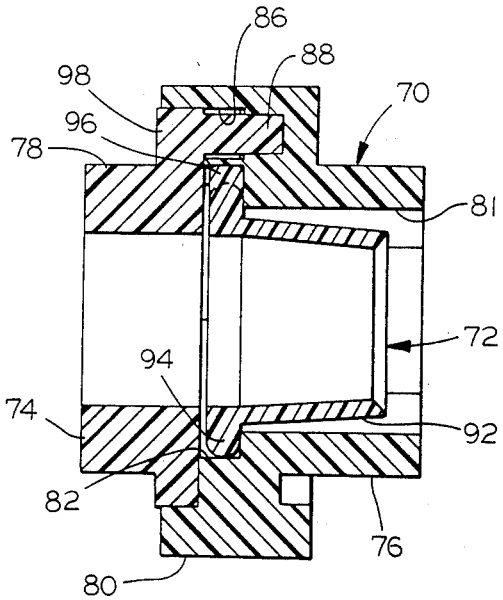
FIG. 8 is an axial sectional view of the drive pulley drawn to an enlarged scale.
Figure 9:
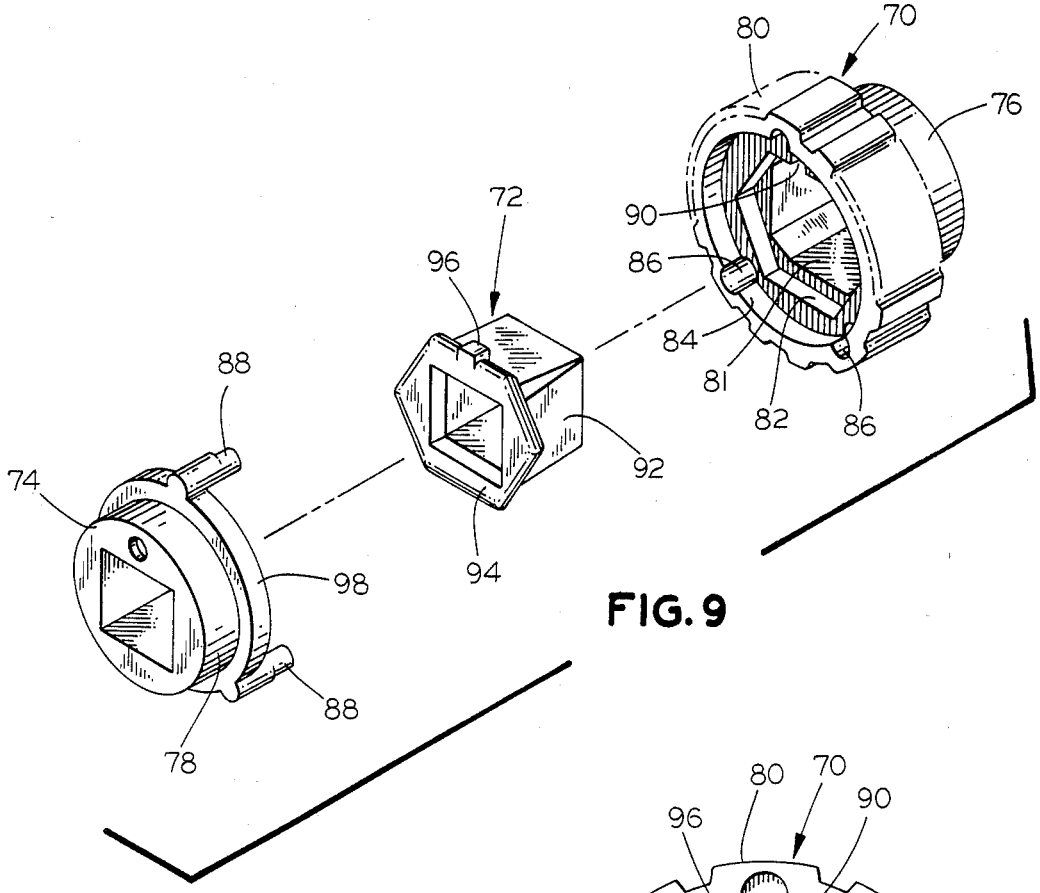
FIG. 9 is an exploded view of the drive pulley.
Figure 10:
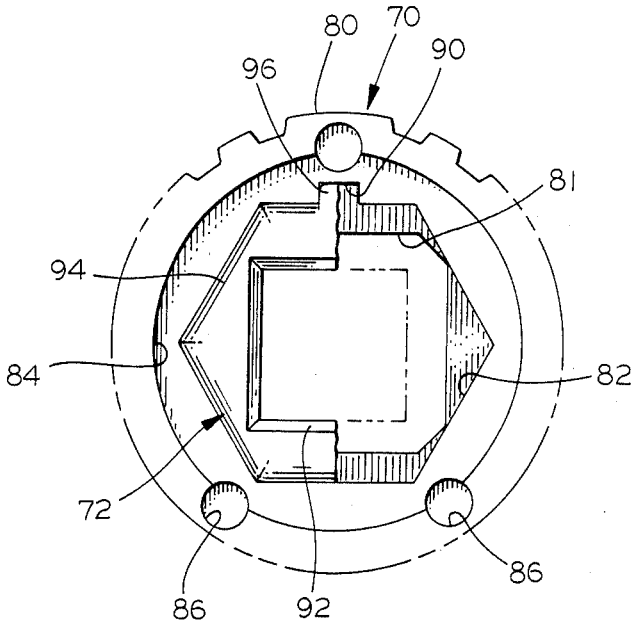
FIG. 10 is a side elevational view of the drive pulley with portions removed or broken away for clarity of illustration.

As best seen in FIGS. 8 through 10, the cantable insert 72 which is matingly received within the compensating pulley body 70 has a tapered rectangular sleeve or body portion 92 which is received within the passage 81 of the pulley body 70. At one end of the rectangular sleeve 92 is the hexagonal or polygonal collar 94 which is cantably but drivingly seated within the hexagonal recess 82 of the pulley body 70. At one point about the collar 94 is the locating boss 96 which seats within the key groove 90 of the compensating pulley body 70 to ensure proper orientation or placement of the insert 72 relative thereto.

The cantable insert 72 and compensating pulley body 70 are cooperatively configured or dimensioned to prevent relative rotation therebetween and thereby effect driving engagement therebetween when the drive shaft 22 rotatively engages the insert 72. The cooperative configuration is provided by a polygonal cross section for at least a portion (collar 94) of the length of the cantable insert 72 and of the body passage 81 (recess 82). The preferred assembly employs a polygonal peripheral configuration for the sleeve or body portion 92 of the insert and a cooperating configuration for the entire length of passage 81 through the pulley body 70.

Referring further to FIGS. 8 and 10, the sleeve or body portion 92 of the cantable insert 72 is disposed within the pulley body passage 81. The body passage 81 is of greater dimension than the outer dimension of the insert body portion 92 so as to provide spacing therebetween. This spacing between the insert body portion 92 and the wall defining the body passage 81 increases from one end of the insert body portion 92 to the other end thereof as the outer dimensions of the body portion 92 decrease. As illustrated, the inner and outer dimensions of the body portion 92 decrease at a substantially equal rate from the one end to the other end thereof to define relatively thin sloping walls of substantially uniform thickness. The spacing thus provided between the insert body portion 92 and the wall defining the body passage 81 permits the insert 72 to be drivingly engaged with the drive shaft 22 and to be canted within the body passage portion 81 while so engaged. The decreasing dimensioning of the body portion 92 allows it to firmly grip the drive shaft despite variations in dimensions which may be encountered between printers, and the thin wall section will permit flexure thereof.

After the cantable insert 72 is properly positioned within the compensating pulley body 70, the compensating pulley cap 74 is inserted into the circular recess 84 and the pins 88 are seated in the pin apertures 86 of the pulley body 70. As seen, the pulley cap 74 has a rectangular, axially extending passage which defines a portion of the drive shaft passage, and the journal portion 78 on its outer end is received in the journal bearing aperture of the tractor chassis 10. The three circumferentially spaced pins 88 are bonded within the pin apertures 86 conventionally by sonic bonding to secure the pulley cap 74 to the pulley body 70 and provide an integrated unit.

Turning to FIG. 8, it can be seen that the cantable insert 72 is captured between the pulley body 70 and the pulley cap 74 within the hexagonal recess 82. However, it should be readily appreciated that the hexagonal recess 82 has an axial depth greater than the thickness of the hexagonal collar 94 of the cantable insert 72 and the peripheral wall of the recess 82 is also greater in dimensions than the peripheral wall of the collar 94. Therefore, the cantable insert 72 is permitted to move axially and transversely of the drive pulley body 70 and the collar 94 thus can rock or cant within the hexagonal recess 82 to orient itself with respect to the drive pulley 16 and thus the tractor chassis 10. The clearance between the hexagonal collar 94 and the recess, for example, can be twenty-thousandths of an inch which will accommodate ten-thousandths of an inch of eccentricity in the drive shaft 22 as will be subsequently explained. As previously indicated, the body portion 92 of the insert 72 is spaced from the wall defining the passage 81 in the pulley body 70 so that it freely cants therewithin.

In operation, the drive pulley 16 is rotatably mounted by means of the journal portions 76 and 78 in the drive shaft aperture of the tractor. When the drive and support shafts are received within the appropriate apertures in the drive tractor, pressing the spring clamp tab portions 42 of the tractor together will open the passage in the barrel portion 40 of the spring clamp subassembly to allow positioning of the tractor on the support and drive shafts relative to each other to adjust to the width of the paper web 28. The drive shaft 22 is snugly received within the drive pulley 16 drivingly engages the wall surface defining the passage through the rectangular body portion 92 of the cantable insert 72. Tolerance in dimensions or in its configuration is accommodated by canting of the insert 72 or flexure of the sleeve 92.

When the printer is operated, the drive shaft 22 rotates and drives the drive pulley 16, any eccentricity in the axis of rotation of the drive shaft 22 will cause the cantable insert 72 to rock or cant to orient itself within the drive pulley body 70 to accommodate such eccentricity. As previously indicated, the cantable insert 72 will also accommodate abnormalities or inaccuracies in dimensions or configurations of the drive shaft 22 and minor variations in spacing between the two shafts.

It should be noted that the type of support shaft clamp (spring clamp subassembly) used in combination with the compensating pulley 16 should ensure proper operation of the tractor. The clamp should engage the support shaft 24 without changing the center to center spacing between the drive and support shafts or producing a clamping torque thereon. If the clamp were to change the center to center spacing, e.g. by deflecting the support shaft 24 during the clamping operation, the cantable insert 72 would be reoriented or canted within the pulley body to compensate for the deflection. If the deflection and thus the compensation needed were substantial, the cantable insert 72 would be unable to compensate for other variations and eccentricities in the system. The spring clamp subassembly disclosed in the copending Milano application provides means to maintain the original spacing between the support and drive shafts and relieves torque initiated as the clamp engages the associated support shaft without depleting the scope of compensation provided by the cantable insert pulley of the present invention.

As will be appreciated, the pulleys of the tractors of the present invention may be of the type illustrated having teeth formed thereon to engage cooperating teeth on the driven surface of the belt, or they may employ a friction surface to engage a frictionally driven surface on the belt, or they may employ any other suitable means for effecting driving engagement therebetween.

As is conventional for larger tractors, an idler pulley may be employed at the other end of the chassis to provide the belt support surface rather than the arcuate shoe surface of the illustrated embodiment. Such idler pulley assemblies are shown in the aforementioned Seitz patents. Moreover, this type of assembly may have a chassis body having a third aperture for the idler pulley.

Thus, it can be seen from the foregoing detailed specification and attached drawings that the drive tractor of the present invention readily accommodates abnormalities or inaccuracies in the drive shaft, minor variations in spacing between the two shafts and irregularities or eccentricities on rotation of the drive shaft. The tractors may be readily fabricated from relatively economically fabricated parts and are adapted to provide long lived, trouble free operation.

Having thus described the invention, what is claimed is:

1. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage therethrough extending along an axis perpendicular to the radius defining said peripheral surface portion of said pulley and substantially coaxial with said one chassis aperture, said pulley also having a cantable insert received within said body passage and cantable in said body passage relative to said body, said insert having a passage therethrough providing at least a portion of said shaft receiving passage extending through said pulley, said portion of said shaft receiving passage provided by said insert passage being configured and dimensioned to grip the associated drive shaft at all times, whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

2. The drive tractor in accordance with claim 1 wherein said pulley body passage and the periphery of said cantable insert are cooperatively configured to effect driving engagement between said insert and said pulley body.

3. The drive tractor in accordance with claim 2 wherein said cooperative configuration is provided by a polygonal cross section for at least a portion of the length of said cantable insert and of said body passage.

4. The drive tractor in accordance with claim 1 wherein said cantable insert has a body portion disposed within said pulley body passage and wherein said pulley body passage and said insert body portion are cooperatively dimensioned to provide spacing therebetween to permit canting of said insert within said body passage.

5. The drive tractor in accordance with claim 1 wherein said passage through said cantable insert decreases in cross sectional area from one end thereof to its other end to drivingly engage the associated drive shaft at some point along the length of said cantable insert passage.

6. The drive tractor in accordance with claim 5 wherein said cantable insert includes a body portion providing at least a portion of said passage through said cantable insert, the peripheral wall of said body portion tapering from one end of said body portion to the other end thereof to define a reduced cross section for driving engagement by the associated drive shaft.

7. The drive tractor in accordance with claim 1 wherein said pulley includes a pulley cap engaged on one end of said pulley body to retain said cantable insert within said passage of said pulley body for canting therein.

8. The drive tractor in accordance with claim 1 additionally including means for clamping said chassis on an associated support shaft having its axis extending parallel to the axis of the associated drive shaft disposed in the other of said spaced transversely extending apertures of said chassis.

9. The drive tractor in accordance with claim 8 wherein said clamping means when clamped upon the associated support shaft maintains original spacing between the support and drive shafts and relieves torque initiated as said clamping means engages the associated support shaft.

10. The drive tractor in accordance with claim 9 wherein said clamping means is mounted on said chassis adjacent said other aperture.

11. The drive tractor in accordance with claim 10 wherein said tractor includes convexly arcuate belt support means adjacent the end of said chassis spaced from said drive pulley and wherein the spacing between the center for the radius of said belt support means and the center of said drive pulley is fixed and predetermined.

12. In a drive tractor for web material, the combination comprising:

A. a chassis having a pair of spaced transversely extending apertures therein, at least one of said apertures being adjacent and end thereof;

B. a flexible endless belt extending about said chassis generally perpendicular to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a body with a passage extending therethrough and a cantable insert having a body portion disposed within said body passage, said pulley body passage and said insert body portion cooperatively dimensioned to provide spacing therebetween to permit canting of said insert within the body portion and to effect driving engagement between said insert and said pulley body, said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

13. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage extending therethrough along an axis perpendicular to the radius defining said peripheral surface portion of said pulley and substantially coaxial with said one chassis aperture, said pulley also having a cantable insert with an elongated body portion disposed within said body passage and a collar at one end of said body portion, said pulley body passage and said insert body portion being cooperatively dimensioned to provide spacing therebetween to permit canting of said insert within the body portion and to effect driving engagement between said insert and said pulley body, said pulley body including a recess in one end thereof seating said cantable insert collar, said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

14. The drive tractor in accordance with claim 13 wherein said recess in said one end of said pulley body and said insert collar have a cooperating polygonal configuration to provide interengagement thereof.

15. In a drive tractor for web material, the combination comprising:

A. a chassis having a pair of spaced transversely extending apertures therein, at least one of said apertures being adjacent an end thereof;

B. a flexible endless belt extending about said chassis generally perpendicular to the axes of said apertures, said belt defining a closed path of travel thereabout and having an outer driving surface to engage the web material and an inner driven surface;

C. means for clamping said chassis on an associated support shaft to maintain original spacing between the associated support and drive shaft and to relieve torque therebetween produced as a result of said clamping action on the associated support shaft, said clamping means being disposed in the other of said chassis apertures and having its axis extending parallel to the axis of the associated drive shaft; and D. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage extending therethrough along an axis perpendicular to the radius defining said peripheral surface portion of said pulley and substantially coaxial with said one chassis aperture, said pulley also having a cantable insert having a body portion disposed within said body passage and cantable in said pulley body passage, said body passage and said insert body portion being cooperatively dimensioned to provide spacing therebetween to permit canting of said insert within the body portion and to effect driving engagement between said insert and said pulley body, said insert having a passage therethrough providing at least a portion of said shaft receiving passage extending through said pulley, said portion of said shaft receiving passage provided by said insert passage being configured and dimensioned to grip the associated drive shaft at all times, whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

16. The drive tractor in accordance with claim 15 wherein said cooperative configuration is provided by a polygonal cross section for at least a portion of the length of said cantable insert and of said body passage.

17. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface;

C. means for clamping said chassis on an associated support shaft to maintain original spacing between the associated support and drive shaft and to relieve torque therebetween produced as a result of said clamping action on the associated support shaft, said clamping means being disposed in the other of said chassis apertures and having its axis extending parallel to the axis of the associated drive shaft; and D. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage extending therethrough along an axis perpendicular to the radius defining said peripheral surface portion of said pulley and substantially coaxial with said one chassis aperture, said pulley also having a cantable insert with an elongated body portion disposed within said body passage and cantable in said pulley body passage, said body passage and said insert body portion being cooperatively dimensioned to provide spacing therebetween to permit canting of said insert within the body portion and to effect driving engagement between said insert and said pulley body, said cantable insert having a collar at one end of said body portion and said pulley body including a recess in one end thereof seating said cantable insert collar, said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

18. The drive tractor in accordance with claim 17 wherein said recess in said one end of said pulley body and said insert collar have a cooperating polygonal configuration to provide interengagement thereof.

19. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage therethrough extending along an axis perpendicular to the radius defining said peripheral surface portion of said pulley and substantially coaxial with said one chassis aperture, said pulley also having a cantable insert received within said body passage and cantable in said body passage relative to said body, said cantable insert having a body portion disposed within said pulley body passage, in said pulley body passage and said insert body portion being cooperatively dimensioned to provide spacing therebetween to permit canting of said insert within said body passage, said spacing between said insert body portion and said body passage increasing from one end of said insert body portion to the other end thereof said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

20. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage therethrough extending along an axis perpendicular to the radius defining said peripheral surface portion of said pulley and substantially coaxial with said one chassis aperture, said pulley also having a cantable insert received within said body passage and cantable in said body passage relative to said body, said cantable insert including an elongated body portion and a collar at one end of said body portion, said pulley body including a recess in one end thereof seating said collar, said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

21. The drive tractor in accordance with claim 20 wherein said recess in said one end of said pulley body and said insert collar have a cooperating polygonal configuration to provide interengagement thereof.

22. In a drive tractor for web material, the combination comprising:

A. a chassis having a pair of spaced transversely extending apertures therein, at least one of said apertures being adjacent an end thereof;

B. a flexible endless belt extending about said chassis generally perpendicularly to the axes of said apertures, said belt defining a closed path of travel thereabout and having an outer driving surface to engage the web material and an inner driven surface; and C. a pulley rotatably mounted in said one of said chassis apertures for rotation within said one chassis aperture with its peripheral surface portion in engagement with said driven surface of said belt, said pulley having a passage therethrough for receiving a drive shaft to effect rotation of said pulley and thereby said belt, said pulley having a body with a passage extending therethrough along an axis perpendicular to the radius defining said peripheral surface portion of said pulley and substantially coaxial with said one chassis aperture, said pulley also having a cantable insert having a body portion disposed within said body passage, said pulley body passage and said insert body portion being cooperatively dimensioned to provide spacing therebetween to permit canting of said insert within the body portion and to effect driving engagement between said insert and said pulley body, said spacing between said insert body portion and said body passage increasing from one end of said insert body portion to the other end thereof, said insert having a passage therethrough providing at least a portion of said shaft receiving passage extending through said pulley whereby the associated drive shaft may produce canting of said cantable insert within said body passage to accommodate irregularities in the associated drive shaft and variations in spacing between the axes of the associated shafts during operation of the tractor, the radius of the peripheral surface portion of said pulley being substantially perpendicular to the closed path of travel of said belt during rotation of said pulley.

* * * * *